US007065830B2

(12) United States Patent
Bushey

(10) Patent No.: US 7,065,830 B2
(45) Date of Patent: Jun. 27, 2006

(54) DOOR STOP

(76) Inventor: Richard D. Bushey, 1596 38th Ave., Kenosha, WI (US) 53140

( * ) Notice: Subject to any disclaimer, the term of this patent is extended or adjusted under 35 U.S.C. 154(b) by 0 days.

(21) Appl. No.: 10/795,902

(22) Filed: Mar. 8, 2004

(65) Prior Publication Data

US 2005/0193520 A1 Sep. 8, 2005

(51) Int. Cl.
*E05F 5/02* (2006.01)

(52) U.S. Cl. ..... 16/82; 16/85; 292/338

(58) Field of Classification Search ..... 16/82, 16/85, 86 R, 86 A, 86 B, 374–376; 292/DIG. 15, 292/DIG. 19, 297, 304, 262, 288, 251.5, 292/338–339, 342–343
See application file for complete search history.

(56) References Cited

U.S. PATENT DOCUMENTS

| | | | | | |
|---|---|---|---|---|---|
| 1,515,091 | A | * | 11/1924 | Brower et al. | 292/204 |
| 1,698,944 | A | * | 1/1929 | De Foe | 292/338 |
| 1,800,086 | A | | 4/1931 | Larson | |
| 2,121,490 | A | * | 6/1938 | Sasgen et al. | 292/338 |
| D120,752 | S | | 5/1940 | Gallinger | |
| 2,414,404 | A | | 1/1947 | Youther | |
| 2,606,053 | A | | 8/1952 | Wingate, Jr. | |
| 2,709,615 | A | * | 5/1955 | Barnes, Jr. et al. | 292/339 |
| 2,762,641 | A | * | 9/1956 | Gilmour | 292/63 |
| 3,731,341 | A | | 5/1973 | Woodruff | |
| 4,163,574 | A | * | 8/1979 | Chezem | 292/338 |
| 4,395,065 | A | * | 7/1983 | Nelson et al. | 292/339 |
| 4,456,291 | A | | 6/1984 | Brogie | |
| 4,494,784 | A | * | 1/1985 | Haynes | 292/233 |
| 4,514,000 | A | | 4/1985 | Chezem et al. | |
| 4,673,203 | A | * | 6/1987 | Chezem | 292/339 |
| 4,822,086 | A | | 4/1989 | Brown | |
| 5,040,835 | A | * | 8/1991 | Barker | 292/338 |
| 5,250,927 | A | | 10/1993 | Nevels | |
| 5,542,725 | A | * | 8/1996 | Ballew | 292/339 |
| 5,673,952 | A | | 10/1997 | Chezem et al. | |
| 5,676,410 | A | | 10/1997 | Angerbrandt | |
| 6,345,849 | B1 | * | 2/2002 | Yen | 292/343 |

FOREIGN PATENT DOCUMENTS

| | | | | |
|---|---|---|---|---|
| JP | 09324575 | A | * | 12/1997 |
| JP | 2000160910 | A | * | 6/2000 |
| JP | 2000204822 | A | * | 7/2000 |
| JP | 2002061444 | A | * | 2/2002 |
| JP | 2003278429 | A | * | 10/2003 |
| WO | WO 8902509 | A1 | * | 3/1989 |
| WO | WO 3048488 | A1 | * | 6/2003 |

* cited by examiner

*Primary Examiner*—Chuck Y. Mah
(74) *Attorney, Agent, or Firm*—Boyle Fredrickson Newholm Stein & Gratz S.C.

(57) ABSTRACT

A door stop is provided for retaining a door in a user selected position. The door stop includes a support connectable to the door adjacent the bottom thereof and a stop member pivotably connected to the support. The stop member is pivotable between a first retracted position and a second extended position wherein at least a portion of the stop member is below the bottom of the door.

10 Claims, 6 Drawing Sheets

DOOR STOP

FIELD OF THE INVENTION

This invention relates generally to door stops, and in particular, to a door stop that may be mounted on the bottom portion of a conventional door that allows a user to maintain the door at a user desired location.

BACKGROUND AND SUMMARY OF THE INVENTION

As is known, various types of door props or door stops have been developed to either prevent a door from being opened or to maintain an open door at a user desired position. By way of example, Youther, U.S. Pat. No. 2,414,404 discloses a door stop that is attached to the lower portion of the door for holding a door in an open or a partly opened position. The door stop disclosed in the Youther '404 patent includes a U-shaped wire carrier pivotally connected to a plate. The plate is interconnected to a door by a plurality of screws. The terminal ends of the wire carrier are interconnected by a stop block. The stop block may be pivoted between a first position wherein the stop block does not interfere with the opening and closing of the door and a second position wherein the stop block engages the supporting surface such as the floor. With the stop block in engagement with the supporting surface, the door is maintained in such position.

While the door stop disclosed in the Youther '404 patent is functional for its intended purpose, the door stop has certain limitations. More specifically, it can be appreciated that the position of the door stop when mounted to the door is not adjustable. As a result, a user must take great care in mounting the plate of the door stop to the door in order to insure that the stop block properly engages the supporting surface. Further, by using screws to interconnect the plate of the door stop to the door, the door is permanently marred. As such, it is highly desirable to provide a door stop that may be simply and easily attached to and removed from a door. In addition, it is highly desirable to provide a door stop that may be mounted to or removed from a corresponding door, without damaging the door.

Therefore, it is a primary object and feature of the present invention to provide a door stop for retaining a door at a user desired selected position that is simple to utilize and inexpensive to manufacture.

It is a further object and feature of the present invention to provide a door stop for retaining a door at a user selected position that may be mounted on the door without damage thereto.

It is a still further object and feature of the present invention to provide a door stop for retaining a door in a user selected position that may be adjusted to accommodate variances in the spacing between the bottom of the door and the supporting surface above which the door pivots.

In accordance with the present invention, a door stop is provided for retaining a door having a bottom in a user selected position. The door stop includes a generally U-shaped clip having an inner surface that defines a cavity for receiving a portion of the bottom of the door therein. A biasing structure is operatively connected to the clip. The biasing structure is engageable with the portion of the bottom of the door received in the cavity for maintaining the clip on the portion of the bottom of the door. A stop member is pivotably connected to the clip. The stop member is pivotable between a first storage position and a second extended position wherein at least a portion of the stop member is below the bottom of the door.

The clip may include first and second vertical walls interconnected by a base. The base extends from the first vertical clip into the cavity. The first vertical wall has a first end integral with the base and the second opposite end. The biasing structure includes a generally flat plate having a first end interconnected to the second end of the vertical wall and a second end. The second end of the plate is engageable with the door and is generally arcuate.

The stop member may include a generally flat plate having a first end pivotably connected to the clip and the second free end. A pad is affixed to a first side of the plate. The pad is engageable with a supporting surface with the stop member in the extended position. The pad includes a generally flat side affixed to the first side of the plate and a generally arcuate side engageable with the supporting surface. A stop retention structure may be interconnected to the clip for selectively retaining the stop member in the storage position.

Alternatively, it is contemplated to provide the plurality of vertically spaced, horizontally extending apertures in the sides of the second vertical wall of the clip such that each aperture in the first side of the second vertical wall is axially aligned with the corresponding aperture in the second side of the vertical wall. In such embodiment, the stop member includes first and second legs. Each leg has a free end and an opposite second end. The free ends of the first and second legs of the stop member are receivable in corresponding user selected apertures in the first and second sides of the second vertical wall. The second ends of the first and second legs of the stop member are interconnected by a pad. The pad is engageable with the supporting surface with the stop member in the extended position. Each leg of the stop member may define a foot engagement area to facilitate the pivoting of the stop member between the storage and the extended positions.

In accordance with a further aspect of the present invention, a door stop is provided for retaining a door having a bottom in a user selected position. The door stop includes a support connectable to the door adjacent the bottom and a stop member pivotably connected to the support. The stop member is pivotable within a first storage position and a second end in the extended position wherein at least a portion of the stop member is below the bottom of the door.

A mounting structure may be used to interconnect the support to the door. The mounting structure may include an adhesive. It is contemplated for the support to include first and second sides. Each side of the support includes a plurality of vertically spaced, horizontally extending recesses therein such that each recess in the first side of the support is axially aligned with the corresponding recess in the second side of the support. The stop member may include first and second legs. Each leg has a free end and an opposite second end. The free ends of the first and second legs are receivable in corresponding user selected recesses in the first and second sides of the support. The second ends of the first and second legs of the stop are interconnected by a pad. The pad is engageable with a supporting surface with the stop member in the extended position. The stop member may also define a foot engagement area which facilitates the pivoting of the stop member between the storage position and the extended position.

The support may take the form of a generally U-shaped clip having an inner surface that defines a cavity for receiving a portion of the bottom of the door therein. A biasing structure is operatively connected to the clip and is engageable with a portion of the bottom of the door when the bottom of the door is received in the cavity. The biasing structure maintains the clip on the portion of the bottom of the door.

Alternatively, the stop member may include a generally flat plate having a first end pivotally connected to the support and a second free end. A pad is affixed to a first side of the plate. The pad is engageable with the supporting surface with the stop member in the extended position. A stop retention structure is interconnected to the support for selectively retaining the stop in the storage position.

In accordance with a still further aspect of the present invention, a door stop is provided for retaining a door having a bottom in a user selected position. The door stop includes a support connectable to the door adjacent the bottom and a retaining structure for retaining the support on the door. The stop member is pivotably connected to the support. The stop member is pivotable between a storage position and second extended position wherein at least a portion of the stop member is engageable with the supporting surface below the bottom of the door.

The support has first and second sides. Each side of the support includes a plurality of vertically spaced, horizontally extended recesses therein such that the recess in the first side of the support are axially aligned with corresponding recesses in the second side of the support. The stop member may include first and second legs. Each leg having a free end and an opposite second end. The free ends of the first and second legs are receivable in corresponding user selected recesses in the first and second sides of the support. The second ends of the first and second legs of the stop member are interconnected by a pad. The pad is engageable with the supporting surface with the stop member in the extended position. The first and second legs of the stop member may define a foot engagement area to facilitate the pivoting of the stop member between the storage and the extended positions.

The support may take the form of a U-shaped clip having an inner surface that defines a cavity for receiving a portion of the bottom of the door therein. The retaining structure includes a biasing element that is operatively connected to the clip. The biasing element is engageable with the portion of the bottom of the door received in the cavity to maintain the clip on the portion on the bottom of the door.

Alternatively, the stop member may include a generally flat plate having a first end pivotably connected to the support and a second free end. The stop member may also include a pad having a generally flat side affixed to a first side of the plate and a generally arcuate side engageable with the supporting surface. A stop retention structure may be interconnected to the support for selectively retaining the stop member in the storage position.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
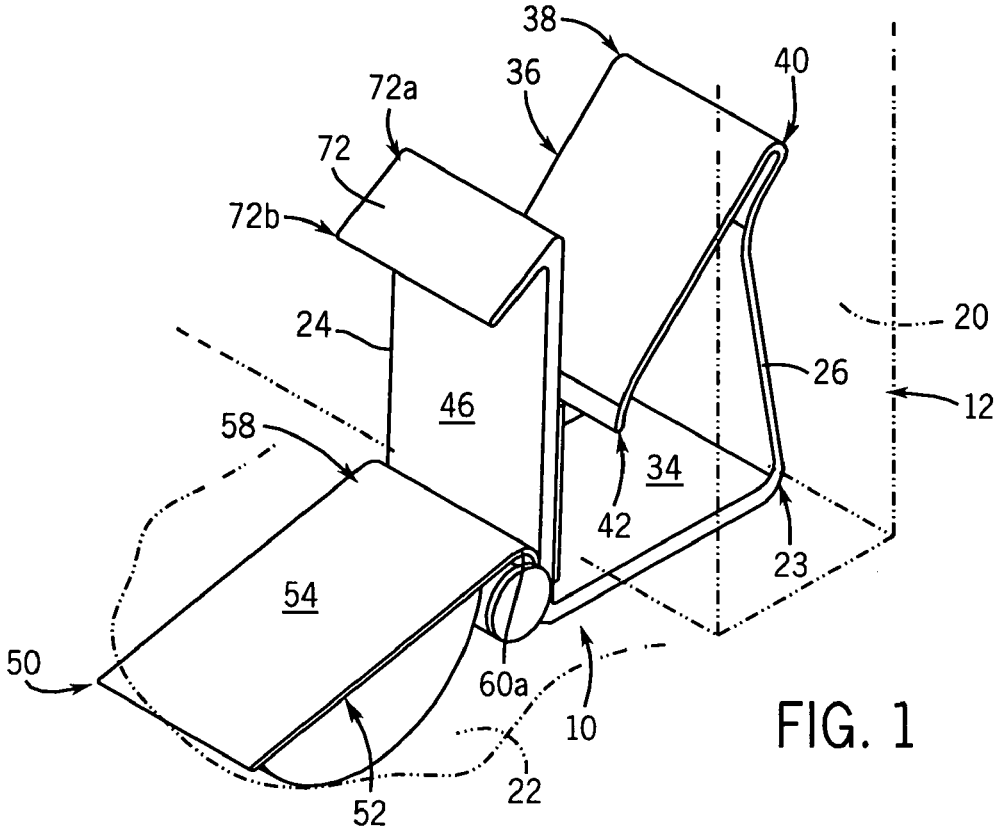
FIG. 1 is an isometric view of a first embodiment of a door stop in accordance with the present invention.
Figure 2:
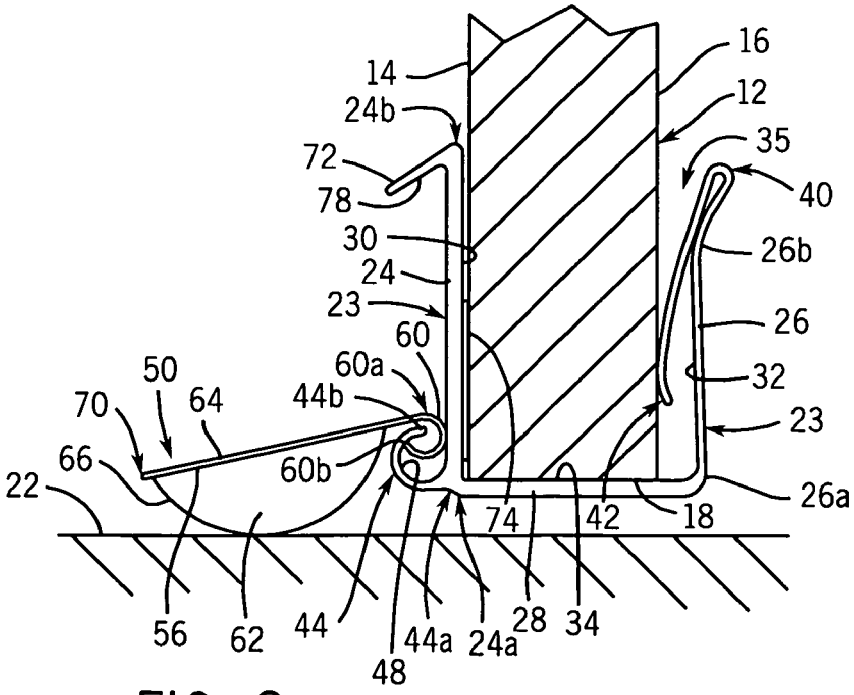
FIG. 2 is a side elevational view, partially in section, of the door stop of FIG. 1 in an extended position.
Figure 3:
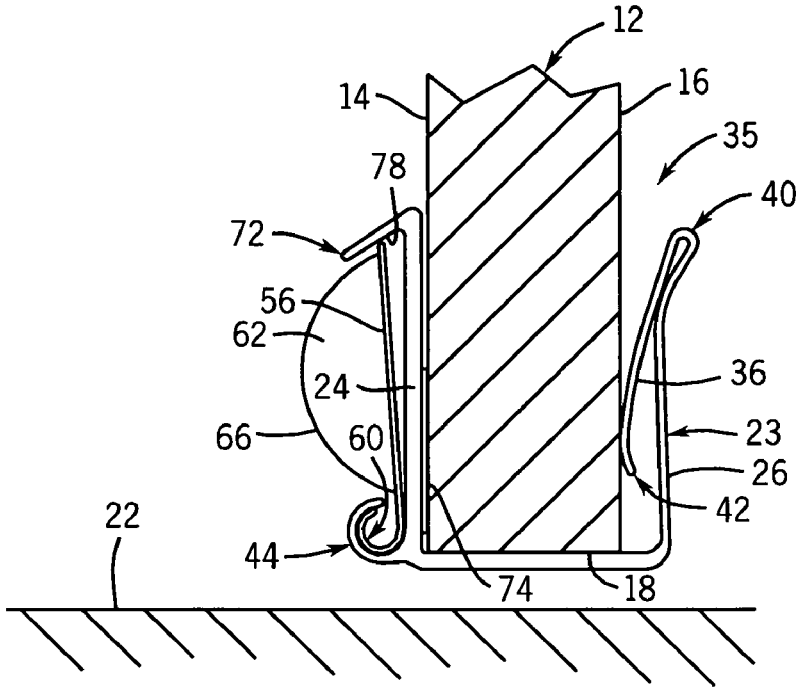
FIG. 3 is a side elevational view, partially in section, of the door stop of FIG. 1 in a storage position.

Referring to FIGS. 1–3, a first embodiment of a door stop in accordance with the present invention is generally designated by the reference numeral 10. It is intended that door stop 10 be mounted on a portion of the bottom of a conventional door 12 having inner face 14, outer face 16, bottom surface 18 and end wall 20. As is conventional, it is intended for door 12 to swing between an open position and a closed position over supporting surface 22 such as a floor or the like.

Door stop 10 includes a generally U-shaped clip 23 defined by first and second vertical walls 24 and 26, respectively, having lower ends 24*a* and 26*a*, respectively, interconnected by a generally flat horizontal base 28. Inner surface 30 of wall 24, inner surface 32 of wall 26 and upper surface 34 of base 28 define cavity 35 for receiving a portion of the bottom of door 12. Door stop 10 further includes a generally flat biasing element 36 having a first end 38 interconnected to upper end 26*b* of second wall 26 by a generally C-shaped spring 40 which extends along the entire width of wall 26 between the opposite sides thereof. Spring 40 urges biasing element 36 into cavity 35. Biasing element 36 includes a second, terminal end 42 that is generally arcuate for reasons hereinafter described. Generally C-shaped hinge part 44 has a first end 44*a* extending from lower end 24*a* of vertical wall 24 and a second end 44*b* being laterally spaced from outer face 46 of vertical wall 24. Hinge part 44 extends along the entire width of vertical wall 24 along lower end 24*a* thereof. Inner surface 48 of hinge part 44 defines a cavity, for reasons hereinafter described.

Stop member 50 includes a generally flat plate 52 having first and second opposite sides 54 and 56, respectively. First end 58 of plate member 52 includes a generally C-shaped hinge part 60 extending along the entire width of first end 58 of plate 52. First end 60*a* of hinge part 60 is integral with first end 58 of plate 52. Second end 60*b* of hinge part 60 is spaced from second side 56 of plate 52 so as to define a gap therebetween. Stop member 50 further includes a resilient pad 62 having a generally flat first surface 64 affixed to second side 56 of plate 52 by any suitable means such as an adhesive or the like. Pad 62 further includes a semi-cylindrical second side 66 for engagement with supporting surface 22 has hereinafter described. It can be appreciated that second end 60*b* of hinge part 60 is adapted for receipt within the cavity defined by hinge part 44. This, in turn, allows stop member 50 to pivot between a retracted position, FIG. 3, and an extended position, FIG. 2. Flexible retaining element 72 projects downwardly from upper end 24*b* of vertical wall 24. First end 72*a* of flexible retaining element 72 extends along the entire width of upper end 28*b* of wall 24. Second, terminal end 72*b* of flexible retaining element 72 extends along an axis generally parallel to upper end 24*b* of wall 24.

In operation, clip 23 is positioned underneath door 12 and urged thereon such that a portion of door 12 is received within cavity 35 and such that bottom surface 18 of door 12 engages upper surface 34 of base 28 of clip 23. The generally arcuate configuration of terminal end 42 of biasing element 36 allows door 12 to be inserted into cavity 35 defined by clip 23. In addition, with door 12 received within cavity 35 of clip 23, terminal end 42 of biasing element 36 engages outer face 16 of door 12 and snuggly retains door 12 in cavity 35 between terminal end 42 of biasing element 36 and inner surface 30 of wall 24 of clip 23. It is contemplated to provide an adhesive 74 between inner surface 30 of wall 24 of clip 23 and inner face 14 of door 12 retain door 12 within the cavity defined by clip 23.

With door 12 retained within cavity 35 defined by clip 23 and with stop member 50 in the retracted position, FIG. 3, door 12 may be pivoted over supporting surface 22 in a conventional manner to a user-selected position. Thereafter, stop member 50 may be pivoted to its extended position, FIG. 2. With stop member 50 in its extended position, second side 66 of pad 62 of stop member 50 engages supporting surface 22 and retains door 12 in the user selected position. Thereafter, if a user would like to move door 12 to another position, stop member 50 is pivoted to the retracted position, FIG. 3, by urging flexible retaining element 72 upwardly so as to allow second side 56 of plate 52 is pivoted into contact with outer face 46 of wall 24. Thereafter, flexible retaining element 72 is released such that lower surface 78 of flexible retaining elements 72 engages terminal end 70 of plate 52, thereby retaining stop member 50 in the retaining position, FIG. 3.

Figure 4:
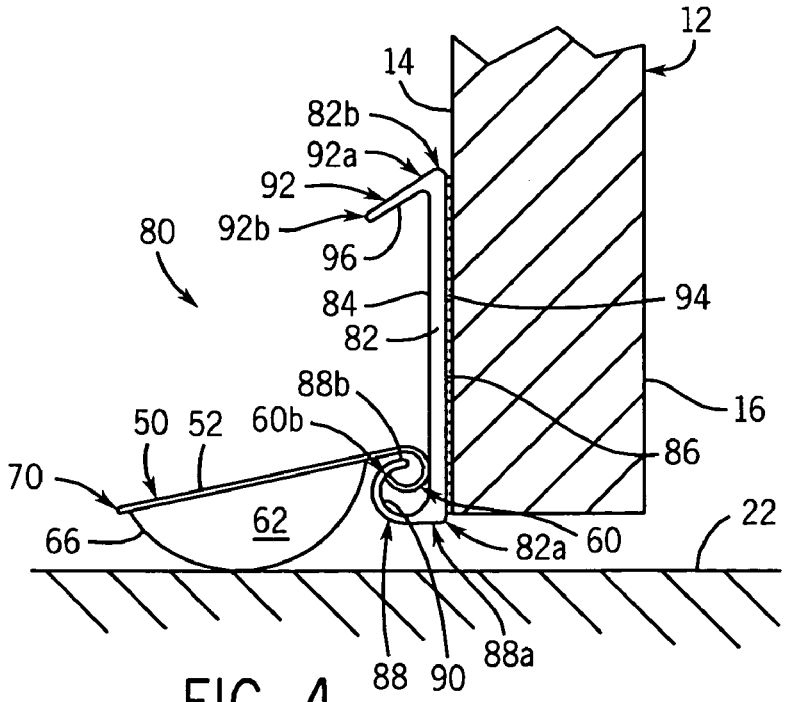
FIG. 4 is a side elevational view, partially in section, of a second embodiment of the door stop in accordance with the present invention in an extended position.
Figure 5:
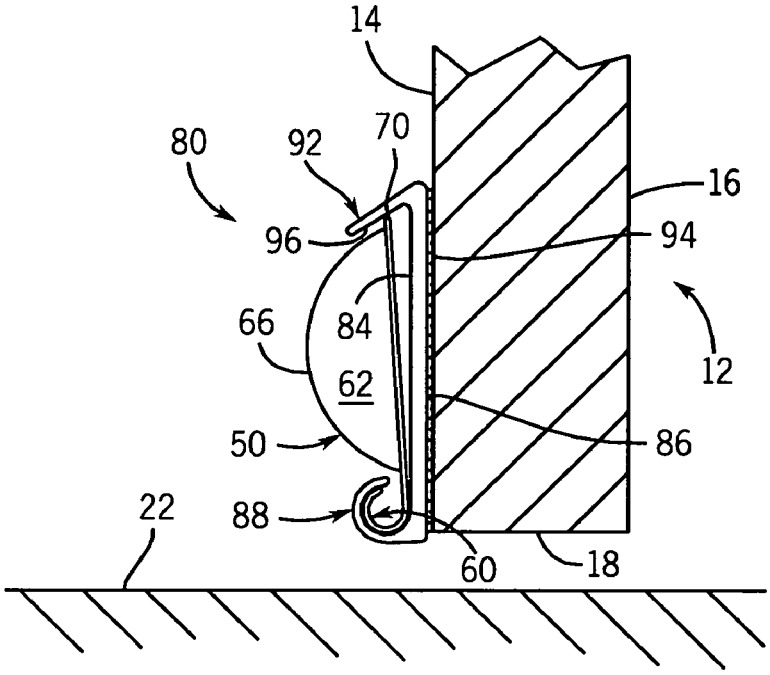
FIG. 5 is a side elevational view, partially in section, of the door stop of FIG. 4 in a storage position.

Referring to FIGS. 4–5, an alternate embodiment of a door stop in accordance with the present invention is generally designated by the reference numeral 80. It is intended to mount door stop 80 on inner face 14 of door 12, as hereinafter described. Door stop 80 includes vertical wall 82 having lower end 82*a* and upper end 82*b*. In addition, vertical wall 82 of door stop 80 includes an outer face 84 and an inner face 86 directed towards inner face 14 of door 12. Generally C-shaped hinge part 88 has a first end 88*a* extending from lower end 82*a* of vertical wall 82 and a second end 88*b* being laterally spaced from outer face 84 of vertical wall 82. Hinge part 88 extends along the entire width of vertical wall 82 along lower end 82*a* thereof. Inner surface 90 of hinge part 88 defines a cavity for receiving second end 60*b* of hinge part 60 of stop member 50. As described, stop member 50 may pivot between an extended position, FIG. 4, and a retracted position, FIG. 5. Stop member 50 is retained in the retracted position, FIG. 5, by flexible retaining element 92 that projects downwardly from upper end 82*b* of vertical wall 82. First end 92*a* of retaining element 92 extends along the entire width of upper end 82*b* of vertical wall 82. Second, terminal end, 92*b* of retaining element 92 extends along an axis generally parallel to upper end 82*b* of vertical wall 82 and is laterally spaced from inner face 84 of vertical wall 82.

In operation, door stop 80 is positioned adjacent the bottom of door 12 against inner face 14 thereof such that lower end 82*a* of vertical wall 82 is slightly below or lies in a generally common plane with bottom surface 18 of door 12. Adhesive 94 affixes inner face 86 of vertical wall 82 to inner face 14 of door 12. With stop member 50 in the retracted position, FIG. 5, door 12 may be pivoted over supporting surface 22 in a conventional manner to a user-desired position. Thereafter, stop member 50 is pivoted to its extended position, FIG. 4, such that second side 66 of pad 62 of stop member 50 engages supporting surface 22 so as retain door 12 in the user-selected position. Thereafter, if the user would like to move door 12 to another position, stop member 50 is returned to the retracted position, FIG. 5, by urging retaining element 92 upwardly so as to allow second side 56 of plate 52 to pivot into contact with outer face 84 of vertical wall 82. Thereafter, retaining element 92 is released such that lower surface 96 of retaining element 92 engages terminal end 70 of plate 52 thereby retaining stop member in the retracted position, FIG. 5.

Figure 6:
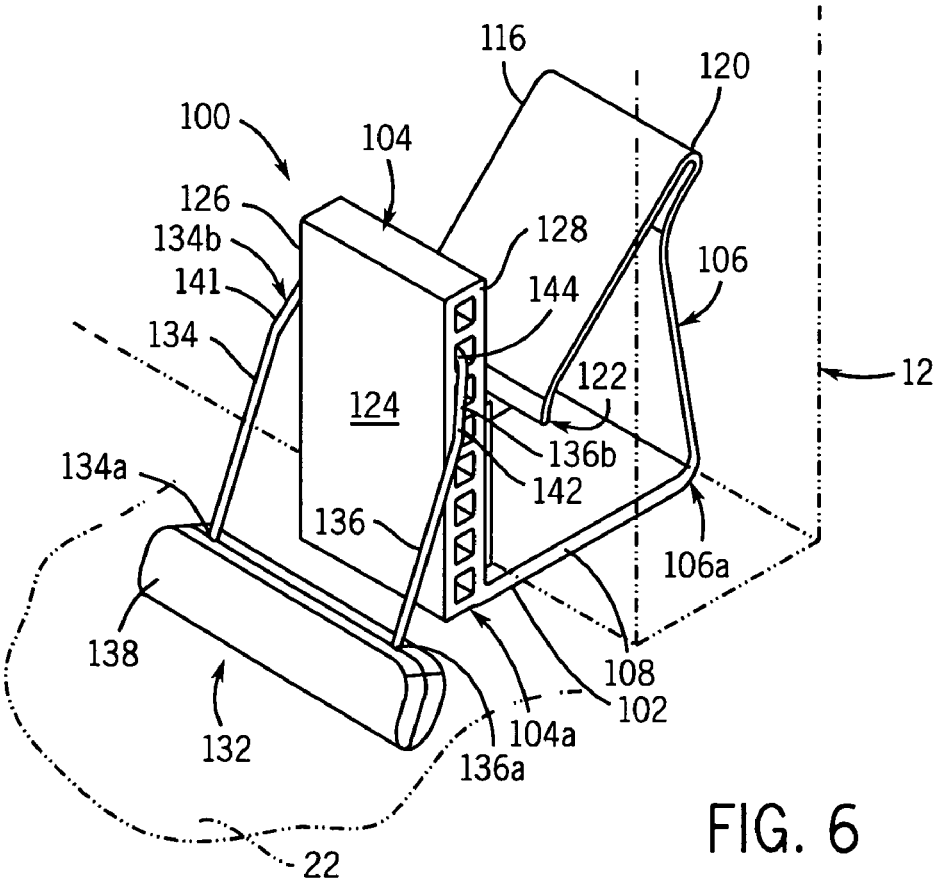
FIG. 6 is an isometric view of a third embodiment of the door stop in accordance with the present invention.
Figure 7:
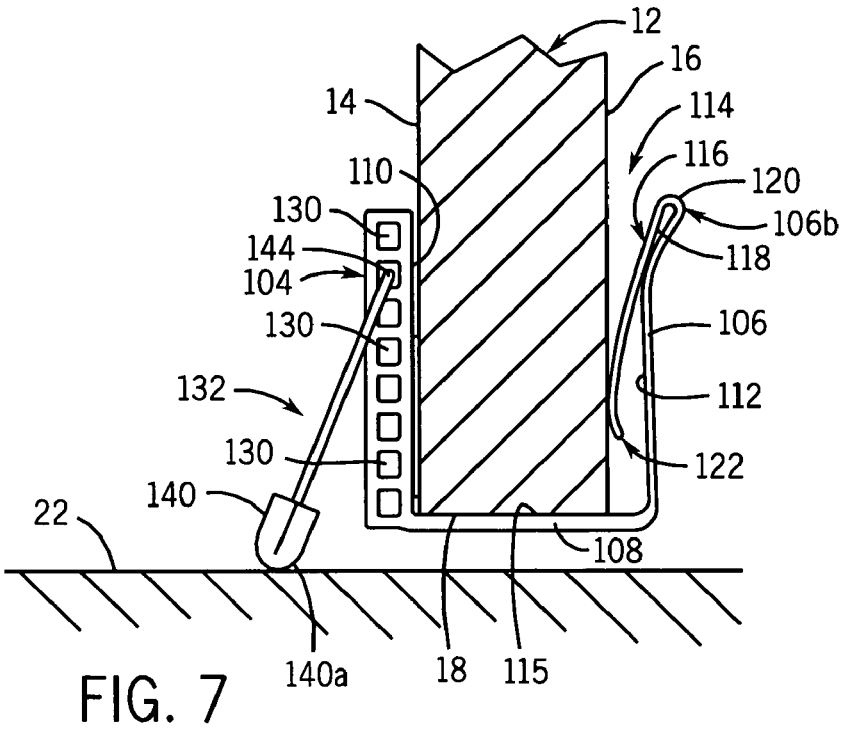
FIG. 7 is a side elevational view, partially in section, of the door stop of FIG. 6 in an extended position.
Figure 8:
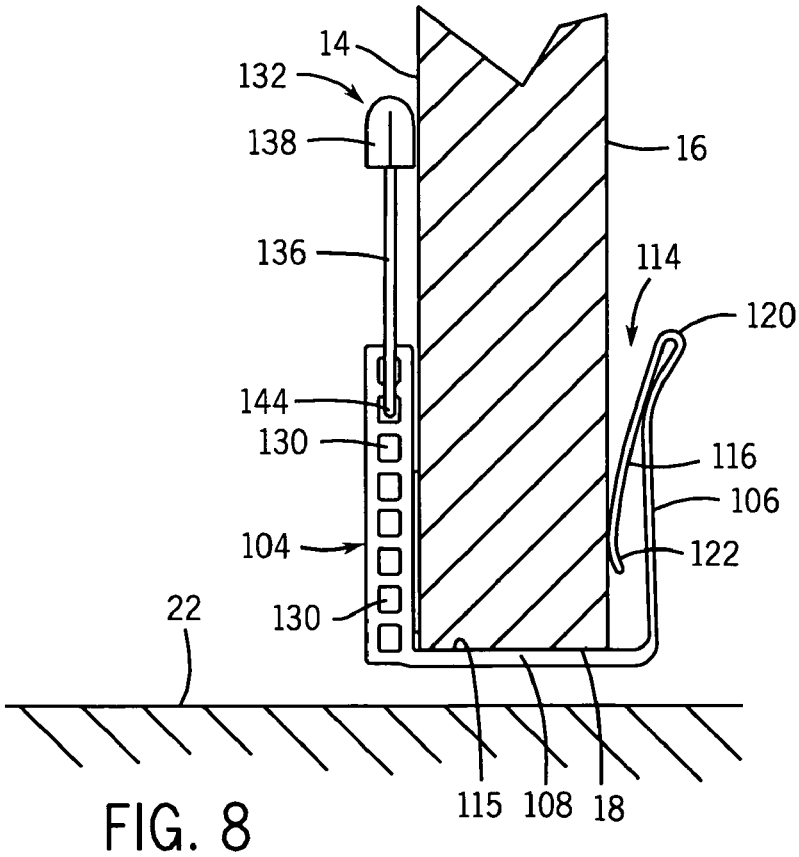
FIG. 8 is a side elevational view, partially in section, of the door stop of FIG. 6 in a storage position.

Referring to FIGS. 6–8, a still further embodiment of a door stop in accordance with the present invention is generally designated by the reference numeral 100. It is intended that door stop 100 be mounted on a portion of the bottom of conventional door 12. Door stop 100 includes a generally U-shaped clip 102 defined by first and second vertical walls 104 and 106, respectively, having lower ends 104*a* and 106*a*, respectively, interconnect by a generally flat horizontal base 108. Inner surface 110 of vertical wall 104, inner surface 112 of vertical wall 106 and upper surface 115 of base 108 define a cavity 114 for receiving a portion of the bottom of door 12.

Door stop 100 further includes a generally flat biasing element 116 having a first end 118 interconnected to upper end 106*b* of vertical wall 106 by a generally c-shaped spring 120 which extends along the entire width of vertical wall 106 between the opposite sides thereof. Spring 120 urges biasing element 116 into cavity 114. Biasing element 116 further includes a second terminal end 122 that is generally arcuate for reasons hereinafter described.

Vertical wall 104 is further defined by outer surface 124 and first and second sides 126 and 128, respectively. A plurality of vertically spaced apertures 130 extend along corresponding axes between first and second sides 126 and 128 of vertical wall 104. As best seen in FIG. 7, it is contemplated for apertures 130 to go entirely through vertical wall 104 between first and second sides 126 and 128 thereof. However, it is contemplated for vertically spaced apertures 130 in first side 126 of vertical wall 104 to be axially aligned, but not communication with vertically spaced apertures 130 in second side 128 of vertical wall 104 without deviating from the scope of the present invention.

Stop member 132 is provided to retain door 12 at a user desired position over supporting surface 22. Stop member 132 includes first and second generally parallel arms 134 and 136, respectively, having first ends 134*a* and 136*a* interconnected by base pad 138. Although not depicted in the drawings, first ends 134*a* and 136*a* of legs 134 and 136, respectively, may also be interconnected by a cross leg, not shown. Pad includes an outer surface 140 having an arcuate portion 140*a* for engaging supporting surface 22, FIGS. 6–7. Second ends 134*b* and 136*b* of legs 134 and 136, respectively, of stop member 132 include angled portions 141 and 142, respectively, that converge towards corresponding sides 126 and 128 of vertical wall 104 and terminate at connectors 144. Connectors 144 on second ends 134*b* and 136*b* of first and second legs 134 and 136, respectively, are directed towards each other and lie on a common axis. It is contemplated for connectors 144 to be receivable in a user selected aperture 130 on opposite sides 126 and 128 of vertical wall 104. It can be appreciated that a user may vary the position of pad 138 of stop member 132 with respect to supporting surface 122 by varying the aperture 130 through vertical wall 104 in which connectors 144 are positioned.

In operation, clip 102 of door stop 100 is positioned underneath door 12 and urged thereon such that a portion of door 12 is received within cavity 114 and such that bottom surface 18 of door 12 engages upper surface 115 of base 108 of clip 102. The generally arcuate configuration of terminal end 122 of biasing element 116 engages outer face 16 of door 12 and snuggly retains door 12 in cavity 114 between terminal end 122 of biasing element 116 and inner surface 110 of vertical wall 104. Adhesive 144 may be provided between inner surface 110 of vertical wall 104 and inner face 14 of door 12 in order to further retain door 12 within cavity 114 defined by clip 102.

With door 12 retained in cavity 114 defined by clip 102, stop member 132 may be pivoted to the retracted position, FIG. 8, such that pad 138 is adjacent inner face 14 of door 12 and lies in a generally common plane with vertical wall 104. As heretofore described, connectors 144 are positioned within a corresponding user selected aperature 130 in vertical wall 104 such that with stop member 132 in its extended position, FIGS. 6–7, outer surface 140, and preferably arcuate portion 140*a* of outer surface 140, of stop member 132 engages supporting surface 22. With stop member 132 in the retracted position, FIG. 8, door 12 may be pivoted in a conventional manner to a user selected position. Thereafter, stop member 132 may be pivoted to its extended position, FIGS. 6–7. With support member 132 in its extended position, outer surface 140, and preferably arcuate portion 140*a* of outer surface 140, engages supporting surface 22 and retains door 12 in the user selected position. If the user desires to move door 12 to another position, stop member 132 is pivoted to the retracted position, FIG. 8, as heretofore described.

Figure 10:
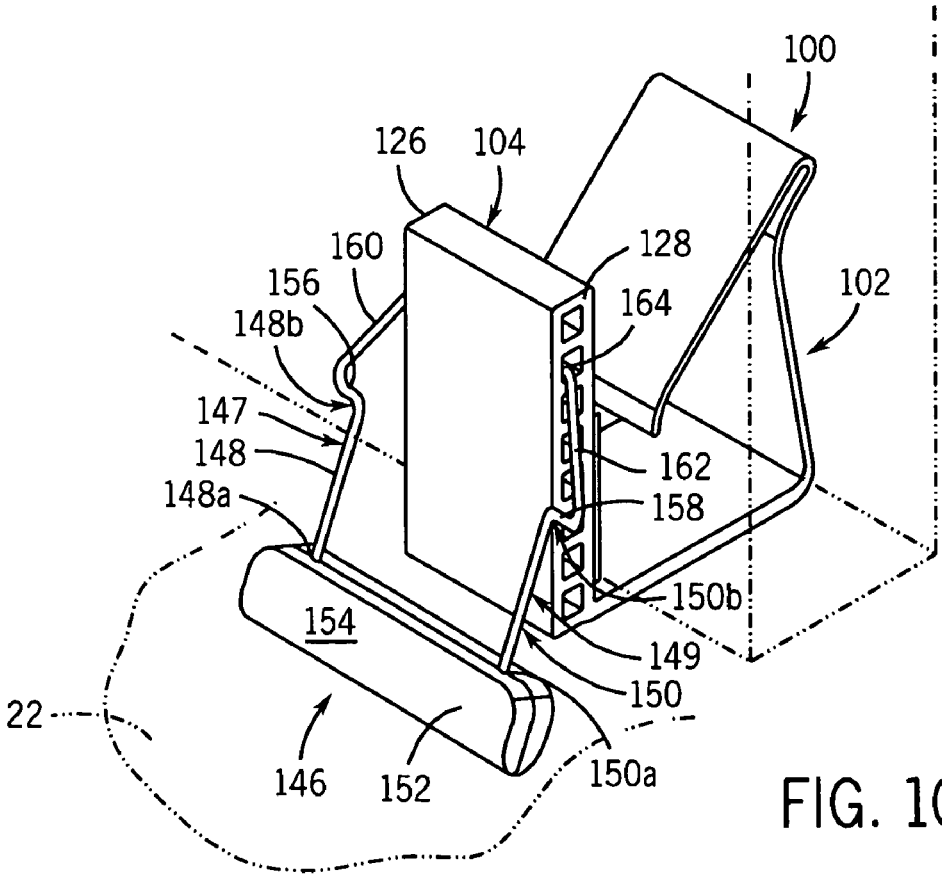
FIG. 10 is an isometric view of a fifth embodiment of a door stop in accordance with the present invention.

Referring to FIG. 10, an alternate stop member for door stop 100 is generally designated by the reference numeral 146. Stop member 146 includes first and second generally parallel legs 147 and 149, respectively. Legs 147 and 149 include leg portions 148 and 150, respectively, having first ends 148*a* and 148*b* interconnected by base pad 152. First ends 148*a* and 150*a* of leg portions 148 and 150, respectively, may also be interconnected by a cross leg (not shown) extending through base pad 152 without deviating from the scope of the present invention. Pad 152 includes outer surface 154 for engaging supporting surface 22. Laterally extending leg portions 156 and 158 extend from corresponding second ends 148*b* and 150*b* of leg portions 148 and 150, respectively, of corresponding legs 147 and 149. In addition, legs 147 and 149 include angled portions 160 and 162, respectively, which extend from the terminal ends of lateral leg portions 156 and 158 and converge towards corresponding sides 124 and 126 of vertical wall 104 of clip 102. Connectors 164 extend from terminal ends of angled portions 160 and 162 of corresponding first and second legs 147 and 149, respectively, towards each other and lie on a common axis. It is intended for connectors 164 to be receivable in a user selected aperture 130 extending between sides 126 and 128 of vertical wall 104. It can be appreciated that a user may vary the position of base pad 152 with respect to supporting surface 122 by varying the aperture 130 through vertical wall 104 in which connectors 164 are positioned.

In operation, clip 102 of door stop 100 is secured to door 12 as heretofore described. Stop member 146 is pivotable between a retracted position such that base pad 152 is adjacent inner face 14 of door 12 and an extended position, FIG. 10, wherein outer surface 154 of base pad 152 engages supporting surface 22. With stop member 146 in the retracted position, door 12 may be pivoted in a conventional manner to a user-selected position. Thereafter, stop member 146 may be pivoted to its extended position, FIG. 10. It is contemplated that lateral leg portions 156 and 158 of corresponding first and second legs 147 and 149, respectively, as well as, angled portions 160 and 162 of corresponding first and second legs 147 and 149, respectively, form foot engaging elements to allow a user to pivot stop member 146 from its retracted position to its extended position, FIG. 10, with the user's foot. With support member 146 in its extended position, outer surface 154 of base pad 152 engages supporting surface 22 and retains door 12 in the user-selected position. If the user desires to move door 12 to another position, stop member 146 is pivoted to the retracted position, heretofore described.

Figure 9:
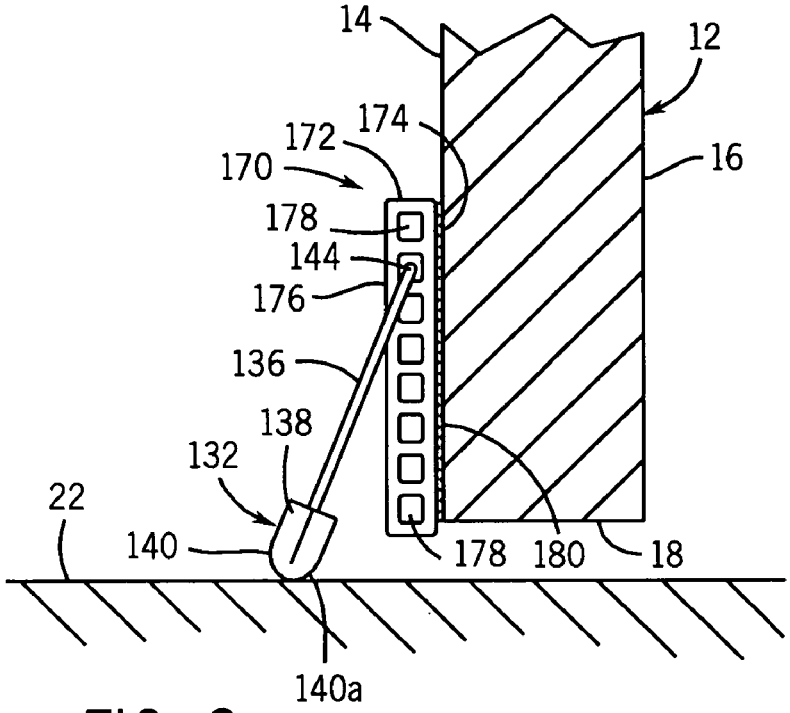
FIG. 9 is a side elevational view, partially in section, of a fourth embodiment of a door stop in accordance with the present invention.

Referring to FIG. 9, an alternate mounting structure for mounting stop member 132 on door 12 is generally designated by the reference numeral 170. Mounting structure 170 includes vertical wall 172 defined by inner and outer surfaces 174 and 176, respectively. A plurality of vertically spaced apertures 178 extend between the sides of vertical wall 172. Connectors 144 of first and second legs 134 and 136, respectively, are positioned within a user selected aperture 178 in vertical wall 172 so as to allow stop member 132 to pivot between the retracted position and an extended position, FIG. 9. Adhesive 180 is provided between inner surface 174 of vertical wall 172 and inner face 14 of door 12 in order to retain vertical wall 172 on door 12.

In operation, vertical wall 172 of mounting structure 170 is attached to inner face 14 of door 12 as heretofore described. Stop member 132 is pivoted to the retracted position such that pad 138 of stop member 132 is adjacent inner face 14 of door 12 and lies in a generally common plane with vertical wall 172. Connectors 144 of first and second legs 134 and 136, respectively, of stop member 132 are positioned within a corresponding user selected aperature 178 through vertical wall 172 such that with stop member 132 in its extended position, FIG. 6, outer surface 140, and preferably arcuate portion 140*a* of outer surface 140, of stop member 132 engages supporting surface 122. With stop member 132 in the retracted position, door 12 may be pivoted in a conventional manner to a user-selected position. Thereafter, stop member may be pivoted to its extended position, FIG. 9. With stop member 132 in its extended position, outer surface 140, and preferably arcuate portion 140*a* of outer surface 140, of pad 138 engages supporting surface 22 and retains door 12 in the user selected position. If the user desires to move door 12 to another position, stop member 132 is pivoted to its retracted position, as heretofore described.

Figure 10A:
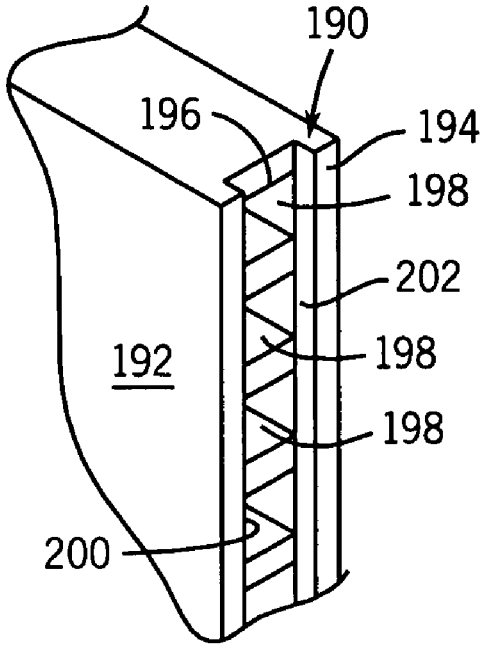
FIG. 10*a* is an isometric view of a portion of a sixth embodiment of a door stop in accordance with the present invention.

Referring to FIG. 10*a*, an alternate embodiment of vertical walls 104, FIG. 10, and 172, FIG. 9, is generally designated by the reference numeral 190. Vertical wall 190 is defined by outer surface 192 and sides, generally designated by the reference numeral 194. Each side 194 includes a recess that terminates at a generally flat, vertical recessed end surface 196 extending between the upper and lower ends of vertical wall 190. A plurality of vertically spaced apertures 198 extend along corresponding axis between opposite end surfaces 196 of vertical wall 190. It is contemplated for apertures 198 to go entirely through vertical wall 190 between end surfaces 196 thereof. However, vertically spaced apertures 198 in one side 196 of vertical wall 190 may be axially aligned with, but not in communication with vertically spaced apertures 198 in the opposite side 196 of vertical wall 104 without deviating from the scope of the present invention.

End surfaces 196 are spaced from corresponding sides 194 by opposing vertical walls 200 and 202. It is contemplated that angled portions 141 and 142 of legs 132 and 136, respectively, of stop member 32 engage the intersections of walls 200 and sides 194 of vertical wall 190 under tension. As a result, as stop member 132 is pivoted to the retracted position, angled portions 141 and 142 of legs 134 and 136, respectively, urge stop member to such retracted position. In addition, when stop member 132 is pivoted to its extended position, the tension generated by angled portions 141 and 142 against sides 194 of vertical wall 190 urges stop member 132 towards its extended position.

It can be appreciated that angled portions 160 and 162 of legs 147 and 149, respectively, of stop member 146 may act in the same manner as angled portions 141 and 142 of legs 134 and 136, respectively, of stop member 132 so as to urge stop member 146 towards its retracted or extended position when stop member 146 is used in connection with vertical wall 190.

Various modes of carrying out the invention are contemplated as being within the scope of the following claims particularly pointing out and distinctly claiming the subject matter which is regarded as the invention.

I claim:

1. A door stop for retaining a door having a bottom in a user selected position, comprising:

a support connectable to the door adjacent the bottom, the support including first and second sides, each side including a plurality of vertically spaced, horizontally extending recesses therein such that each recess in the first side of the support is axially aligned with a corresponding recess in the second side of the support; and a stop member pivotably connected to the support and including first and second legs, each leg having a first free end and an opposite second end, the stop member pivotable between a first storage position and a second extended position wherein at least a portion of the stop member is below the bottom of the door;

wherein the free ends of the first and second legs are receivable in corresponding user selected recesses in the first and second sides of the support and wherein second ends of the first and second legs of the stop member are interconnected by a pad, the pad engageable with a supporting surface with the stop member in the extended position.

2. The door stop of claim 1 further comprising a mounting structure form interconnecting the support to the door.

3. The door stop of claim 2 wherein the mounting structure includes an adhesive.

4. A door stop for retaining a door having a bottom in a user selected position, comprising:

a support connectable to the door adjacent the bottom, the support including first and second sides, each side including a plurality of vertically spaced, horizontally extending recesses therein such that each recess in the first side of the support is axially aligned with a corresponding recess in the second side of the support;

a retaining structure for retaining the support on the door; and a stop member pivotably connected to the support and including first and second legs, each leg having a first free end and an opposite second end, the stop member pivotable between a first storage position and a second extended position wherein at least a portion of the stop member is engageable with a supporting surface below the bottom of the door;

wherein the free ends of the first and second legs are receivable in corresponding user selected recesses in the first and second sides of the support and wherein second ends of the first and second legs of the stop member are interconnected by a pad, the pad engageable with a supporting surface with the stop member in the extended position.

5. The door stop of claim 4 wherein the retaining structure includes an adhesive.

6. A door stop for retaining a door having a bottom in a user selected position, comprising:

a generally flat support member having an inner surface for positioning adjacent a portion of the door adjacent the bottom, an outer surface, and first and second sides; and a stop member pivotably connectable to the support member at a user selected one of a plurality of axially spaced mounting points, the stop member pivotable between a first storage position and a second extended position wherein at least a portion of the stop member is below the bottom of the door;

wherein:

the mounting points are defined by a plurality of vertically spaced, horizontally extending recesses provided in each side of the support member;

the stop member includes first and second legs, each leg having a first free end and an opposite second end; and the free ends of the first and second lens are receivable in corresponding user selected recesses in the first and second sides of the support member;

second ends of the first and second lees of the stop member are interconnected by a pad, the pad engageable with a supporting surface with the stop member in the extended position.

7. The door stop of claim 6 further comprising a mounting structure for interconnecting the support member to the door.

8. The door stop of claim 7 wherein the mounting structure includes an adhesive.

9. The door stop of claim 6 wherein each recess in the first side of the support member is axially aligned with a corresponding recess in the second side of the support member.

10. The door stop of claim 6 wherein each recess in the first side of support member communicates with a corresponding recess in the second side of the support member.

* * * * *